US005376516A

United States Patent [19]

Mochizuki et al.

[11] Patent Number: 5,376,516

[45] Date of Patent: Dec. 27, 1994

[54] SILVER HALIDE PHOTOGRAPHIC LIGHT-SENSITIVE MATERIAL

[75] Inventors: Yoshihiro Mochizuki; Eiichi Ueda, both of Hino, Japan

[73] Assignee: Konica Corporation, Japan

[21] Appl. No.: 263,011

[22] Filed: Jun. 20, 1994

Related U.S. Application Data

[63] Continuation of Ser. No. 12,721, Feb. 3, 1993, abandoned.

[30] Foreign Application Priority Data

Feb. 12, 1992 [JP] Japan ..... 4-025337

[51] Int. Cl.[5] ..... G03C 1/38

[52] U.S. Cl. ..... 430/523; 430/527; 430/631; 430/635; 430/961

[58] Field of Search ..... 430/523, 527, 631, 645, 430/961

[56] References Cited

U.S. PATENT DOCUMENTS 5,075,209 12/1991 Sasaki ..... 430/587

FOREIGN PATENT DOCUMENTS 395107 10/1990 European Pat. Off. .
2260812 9/1975 France .
2012978 8/1979 United Kingdom .

*Primary Examiner*—Thorl Chea
*Attorney, Agent, or Firm*—Jordan B. Bierman

[57] ABSTRACT

A silver halide photographic light-sensitive material is disclosed, which comprises a support and a silver halide photographic emulsion layer and a protective layer provided in that order on a first side of the support, and a backing layer and a protective backing layer provided in that order on a second side of the support opposite to the silver halide photographic emulsion layer, an outermost layer of the material containing a fluorine-containing anionic surfactant and a fluorine-containing cationic surfactant and an outermost layer on the second side of the support containing a compound represented by the Following formula (A) or (B):

Formula (A) RCOOM

Formula (B) $R_1$—CO—O—X—O—CO—$R_2$.

14 Claims, No Drawings

SILVER HALIDE PHOTOGRAPHIC LIGHT-SENSITIVE MATERIAL

This application is a continuation of application Ser. No. 08/012,721, filed Feb. 3, 1993, now abandoned.

FIELD OF THE INVENTION

This invention relates to a silver halide photographic light sensitive material and particularly to a silver halide photographic light sensitive material improved in finger-print smudge resistance, pressure-fog production resistance in a high temperature and a high humidity and adhesion resistance.

BACKGROUND OF THE INVENTION

In recent years, silver halide photographic light sensitive materials have been tried to improve the image-sharpness and to make the sensitivity higher by thinning the layer thickness of the non-light-sensitive protective layers, and the miniaturization of readily portable cameras have become an essential problem.

When reducing the volume of a film cartridge for miniaturizing a camera, it was found that the pullout load of a roll type light sensitive material becomes heavy and particularly remarkably heavier under a high temperature and high humidity conditions. As a result, the drivability of the film is deteriorated in a photographing or projecting apparatus and the pullout load or tension becomes seriously higher. It was, therefore, found that high-speed silver halide photographic light sensitive materials are liable to produce a pressure fog.

There have been various proposals for improving the pressure fogs. For example, a known method for increasing the binder content of a silver halide emulsion layer, in which a silver halide/a binder ratio is lowered. However, this method has a defect that a sharpness is deteriorated and the effect of thinning a non-light-sensitive protective layer is offset against the merits of this method. Besides, Japanese Patent Publication Open to Public Inspection (hereinafter referred to as JP OPI Publication) No. 50-56227/1975 describes a method of adding a polymer latex to an emulsion layer, JP OPI Publication Nos. 53-13923/1978 and 53-85421/1978 describe a method of adding a high boiling organic solvent to an emulsion layer and JP OPI Publication Nos. 50-116025/1975 and 51-107129/1976 describe a method of adding an iridium or thallium salt when preparing silver halide emulsion grains.

Further, as to the methods of applying an improvement in a non-light-sensitive layer, there have been the known methods including, for example, a method of adding fine particles of silica, titanium dioxide, polystyrene or the like to an outermost layer of non-light-sensitive layers, another method of adding paraffin and polyvinyl pyrrolidone into a non-light-sensitive layer as described in JP OPI Publication No. 59-72439/1984, and a further another method of adding oil-drops and fine particle powder into a non-light-sensitive layer comprising two layers as described in JP OPI Publication No. 58-197734/1983. A still further another method of making use of roundish, monodispersive silver halide grains is described in JP OPI Publication No. 59-149349/1984.

Even if making use of any one of the above-given methods, however, it was unable to improve any pressure fogs satisfactorily when a high-speed light sensitive material is loaded in a miniature camera or a miniature cartridge.

On the other hand, the outermost layer of a silver halide photographic light sensitive material is a hydrophilic protective layer containing a binder mainly comprising gelatin. It is, therefore, liable to produce a dust adhesion or a finger-print smudge. Particularly with the recent increase of the so-called "Mini-Lab"s, i.e., the common stores where light sensitive materials are processed by themselves, a dust adhesion and a finger-print smudge are liable to produce on light sensitive materials and, sometimes, photoprints may be so affected as to spoil the commercial values. It was, therefore, found that some action for improvements should be necessary.

To take a countermeasure, there have been some proposals for preventing the above-mentioned adhesions.

For example, U.S. Pat. No. 4,426,431 proposes the polymerizable epoxy and the cationic polymerization initiators for epoxy use, the polymerizable acryl and the radical polymerization initiators of the haloacrylated aromatic ketones and the polymerizable organofunctional silane-containing radiation hardenable compositions, each described in U.S. Pat. No. 4,426,431; the terminal epoxy silane, the aliphatic polyepoxy, the monomers capable of being polymerized with epoxysilane and a compositions comprising the reaction products of the UV absorbents, each described in U.S. Pat. No. 4,136,046; and the compositions containing the cross-linked polymers each described in U.S. Pat. No. 4,262,072. Even each of them has many defects such as that the reaction control may be difficult and the reactivity may be varied in preservation so that the coating operations may be difficult to be made or may not be able to obtain certain specific characteristics or a compound may hardly be available, because they are of the cationic polymerization type.

As for the other example, there are the examples disclosed in JP OPI Publication Nos. 3-240039/1991 and 1-260436/1989 in which a fluorine-containing anionic surfactant and a fluorine-containing cationic surfactant are each used at the same time. In these examples, however, any finger-print smudge production cannot be improved. And, JP OPI Publication No. 62-264043/1987 describes a method in which a protective coated-layer is formed by coating a polymer having a group reactive with gelatin and then by hardening the coated polymer by irradiating radioactive rays. Further, JP OPI Publication No. 3-212640/1991 describes a method in which an ionic polyester is used. As described above, various attempts were tried to form protective coated layers. However, they were not satisfactory in the finger-print smudge prevention effect and raised the problems of lowering a sharpness, producing a devitrification and so forth. Therefore, the above problems has not been solved at all.

To counter the above-mentioned problems, an object of the invention is to provide a silver halide photographic light sensitive material improved in finger-print smudge resistance, pressure fog produced at a high temperature and a high humidity and an adhesion resistance.

SUMMARY OF THE INVENTION

The above-mentioned object of the invention can be achieved with a silver halide photographic light sensitive material comprising a support having at least one silver halide emulsion layer, an emulsion layer and a backing layer and a protective layer each arranged from the both sides with the emulsion layer and the support between, wherein at least one outermost layer of the silver halide photographic light sensitive material contains a fluorine-containing anionic surfactant and a fluorine-containing cationic surfactant and the outermost layer on the backing layer side contains a compound represented by the following Formula (A) or (B).

Formula (A) RCOOM wherein R represents an aliphatic hydrocarbon group and M represents a cation.

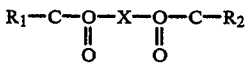

Formula (B)

wherein $R_1$ and $R_2$ represent each an aliphatic hydrocarbon group and X represents a divalent bondage group.

DETAILED DESCRIPTION OF THE INVENTION

The invention will be detailed below.

The fluorine-containing anionic surfactant preferably applicable to the invention includes a compound represented by the following Formula (FA).

$(Cf)_{\overline{}}Y$ Formula (FA)

wherein Cf represents a group having at least three fluorine atoms and at least two carbon atoms; and Y represents —COOM, $—SO_3M$, $—OSO_3M$ or $—P(=O)(OM)_2$ in which M represents a hydrogen atom or a cation such as an alkali metal or a quaternary ammonium group.

The anionic surfactant more preferably applicable thereto includes a compound represented by the following Formula (FA').

$(Rf)_{\overline{}}D—Y$ Formula (FA')

wherein Rf represents a fluorine-containing alkyl group having 3 to 30 carbon atoms or a fluorinated aryl group having 6 to 30 carbon atoms; D represents a divalent bonding group having 1 to 12 carbon atoms and containing at least one bondage of —O—, —COO—, $—CON(R_1)—$ and $—SO_2N(R_1)—$, in which $R_1$ represents an alkyl group having 1 to 5 carbon atoms; and Y represents —COOM, $—SO_3M$, $—OSO_3M$ or $—P(=O)(OM)_2$ in which M represents a hydrogen atom or a cation such as an alkali metal or a quaternary ammonium group.

Next, the typical examples of the compounds will be given below. However, the invention shall not be limited thereto.

$CF_3(CF_2)_6COONH_4$ FA-1

$CF_3(CF_2)_{\overline{9}}(CH_2)_{\overline{10}}COOH$ FA-2

$CF_3(CF_2)_7SO_2—N(C_3H_7)—CH_2CH_2O(CH_2)_3SO_3Na$ FA-3

-continued $CF_3—C(C_2H_5)_2—CH(CF_3)—CF(CF_2Cl)—COONa$ FA-4

$Cl—CF_2(CF(Cl)—CF_2)_{\overline{4}}COOH$ FA-5

$H(CF_2—CF_2)_{\overline{5}}COOH$ FA-6

$HOOC—(CF_2—CF(Cl))_{\overline{4}}CO_2H$ FA-7

$Cl(CF_2—CF(Cl))_3CF_2CO_2K$ FA-8

$CF_3(CF_2)_{\overline{4}}CH=CH—(CH_2)_{\overline{3}}CO_2Na$ FA-9

$CF_3(CF_2)_{\overline{3}}CF(CF_3)—(CH_2)_{\overline{10}}—CO_2Na$ FA-10

$CF_3(CF_2)_{\overline{3}}CO—N(CF_3)(CH_2)_{\overline{2}}CO_2H$ FA-11

$Cl(CF_2—CF_2)_{\overline{3}}CO_2Na$ FA-12

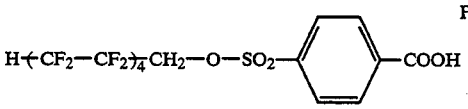

FA-13

$CF_3(CF_2)_{\overline{9}}CH_2CH_2—SO_2—N(C_2H_5)—CH_2—CO_2Na$ FA-14

$C_6F_{13}CON(C_2H_5)CH_2COONa$ FA-15

$CF_3(CF_2)_{\overline{7}}SO_2—N(C_3H_7)—(CH_2)_2—SO_3Na$ FA-16

$C_8F_{17}CON(C_2H_5)CH_2CH_2SO_3Na$ FA-17

$CF_3(CF_2)_{\overline{7}}SO_2—N(C_2H_5)—CH_2—COONa$ FA-18

$CF_3(CF_2)_{\overline{7}}SO_2—N(C_3H_7)—CH_2COOK$ FA-19

$C_8F_{17}SO_2—N(C_3H_7)—(CH_2CH_2O)_4(CH_2)_4SO_3Na$ FA-20

$CF_3—C(C_2F_5)_2—C(SO_3Na)—CHF—CF_3$ FA-21

$NaO_3S—CH(CH_2COOCH_2CH_2NSO_2C_8F_{17})COOCH_2CH_2NSO_2C_8F_{17}$ ($C_3H_7$) FA-22

-continued

FA-23

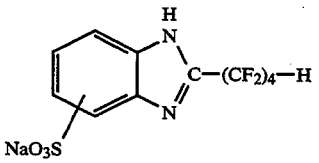

(—$SO_3Na$ is 4th or 5th positioned or the mixture thereof.)

FA-24

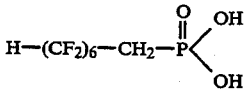

FA-25

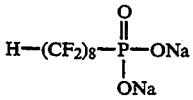

FA-26

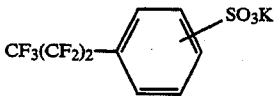

(—$SO_3K$ is o-, m- or p-positioned or the mixture thereof.)

FA-27

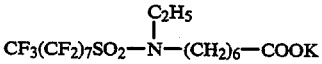

FA-28

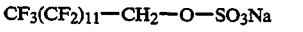

FA-29

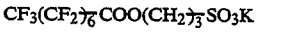

FA-30

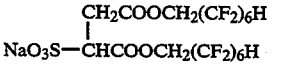

FA-31

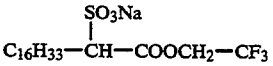

FA-32

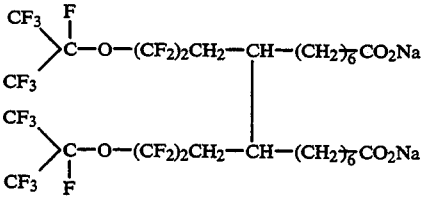

FA-33

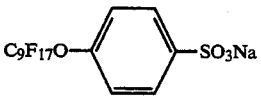

FA-34

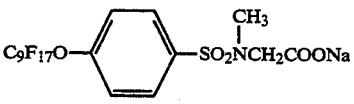

FA-35

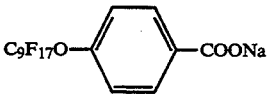

FA-36

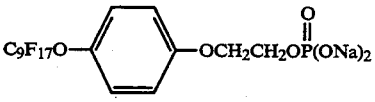

-continued

FA-37

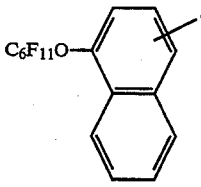

FA-38

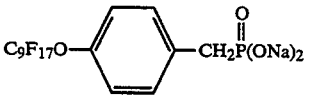

FA-39

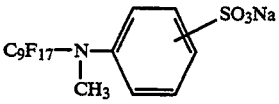

FA-40

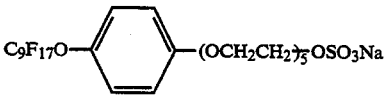

FA-41

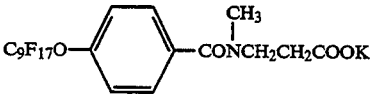

FA-42

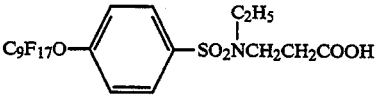

FA-43

FA-44

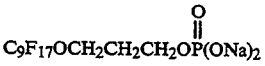

FA-45

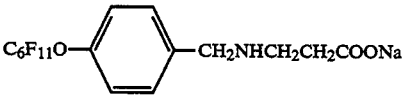

FA-46

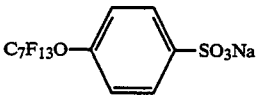

FA-47

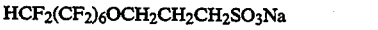

FA-48

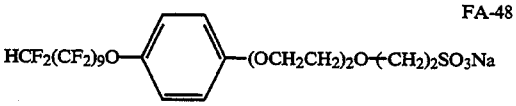

FA-49

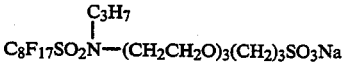

It is particularly desirable to use a fluorine-containing anionic surfactant containing at least one bondage of $—SO_2N(R_1)—$.

The fluorine-containing cationic surfactants applicable to the invention are the compounds represented by the following Formula (FK).

Formula (FK) $Rh—T—X^+Z^-$ wherein Rh represents a hydrocarbon group having 1 to 20 carbon atoms, in which at least one hydrogen atom is substituted with a fluorine atom; T represents a chemical bondage or a divalent group; X represents a cationic group; and Z represents a counter anion.

The examples of Rh may be given as follows; $-C_nF_{2n+1}$, (n=1–20, preferably 3–12), $HC_mF_{2m}-$, $-C_mF_{2m-1}$ and $-C_3mF_6m_{-1}$, (m=2–20, preferably 3–12).

The examples of T may be given as follows;

$-SO_2\overset{R'}{\overset{|}{N}}-(CH_2)_p-$, (R': H, alkyl having 1–6 carbon atoms, and the aklyl may have —OH. p = 0–6), $-CONR'-(CH_2)_p-$, $-O-A'-SO_2NR'-(CH_2)_p-$, (A': allylene, arylene), $-O-A'CONR'-(CH_2)_p-$, $-O-A'-O-(CH_2)_p-$, $-O-A'-(CH_2)_p-$, $-O-(CH_2CH_2O)_q-(CH_2)_p-$, (q = 1–20), $-O-(CH_2)_p-$, $-NR'-(CH_2)_p-$, $-SO_2\overset{R'}{\overset{|}{N}}-(CH_2)_p-O-(CH_2)_r-$, (r = )–6), $-CONR'-(CH_2)_p-O-$, $-O-A'-SO_2NR'-\underset{R'}{\underset{|}{(CH)}}_p-O-A'-$, and $-(CH_2)_p(CHOH)_s(CH_2)_r-$, (s = 0–6)

The examples of X may be given as follows;

$-N^+(R')_3$, $-N^+(CH_2CH_2OCH_3)_3$,

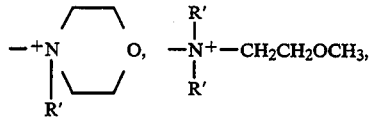

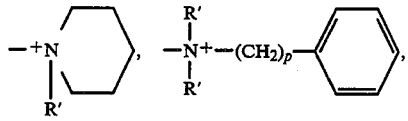

and $-\overset{R'}{\overset{|}{\underset{R''}{\underset{|}{N^+}}}}-R''$ (R'':H, alkyl having 1–6 carbon atoms, and the alkyl may have —OH)

The examples of Z may be given as follows;

$I^-$, $Cl^-$, $Br^-$, $CH_3SO_3^-$,

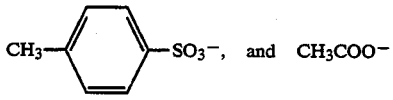

The typical examples of the fluorine-containing cationic surfactants desirably applicable to the invention will be given below.

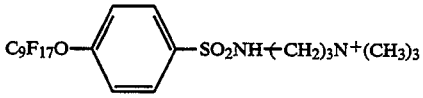

$I^-$ FK-1

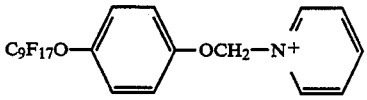

$Cl^-$ FK-2

$C_7F_{15}CONH(CH_2)_3N^+(CH_3)_3$ $Cl^-$ FK-3

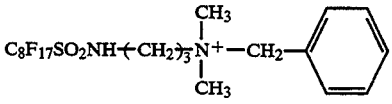

$Cl^-$ FK-4

$C_2F_5CONH(CH_2)_3N^+(CH_3)_3$ $I^-$ FK-5

$C_{12}F_{23}O(CH_2CH_2O)_{\bar{n}}CH_2CH_2N^+(CH_3)_3$ $I^-$ FK-6

$\bar{n} = 5$ $C_9F_{17}O(CH_2)_3N^+(CH_3)_3$

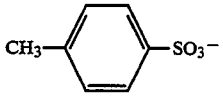

FK-7

$C_8F_{17}SO_2NH(CH_2)_3N^+(CH_3)_3$ $I^-$ FK-8

$C_8F_{17}SO_2NH(CH_2)_3N^+(CH_2CH_2OCH_3)_3$ $I^-$ FK-9

-continued

| | | |
|---|---|---|
| 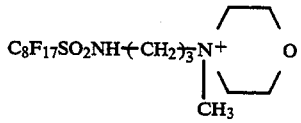 | $I^-$ | FK-10 |
| $C_7F_{15}CONH(CH_2)_3N^+(CH_3)_2-CH_2CH_2OCH_3$ | $Br^-$ | FK-11 |
| $C_9F_{19}CONH(CH_2)_5N^+(CH_3)_3$ | $I^-$ | FK-12 |
| $C_8F_{17}SO_2NH(CH_2)_3OCH_2CH_2N^+(CH_3)_3$ | 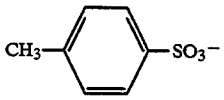 | FK-13 |
| $C_{12}F_{25}CONH(CH_2)_3OCH_2CH_2N^+(CH_3)_3$ | 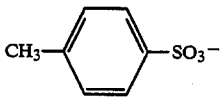 | FK-14 |
| $C_8F_{17}SO_2-N(C_3H_7)-(CH_2)_3N^+(CH_3)_3$ | $I^-$ | FK-15 |
| 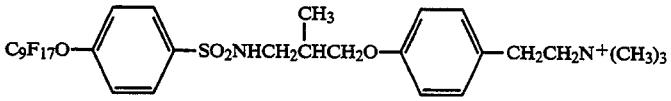 | $I^-$ | FK-16 |
| $C_8F_{17}SO_2(CH_2)_3N^+(CH_3)_2-CH_2CH_2OH$ | $Br^-$ | FK-17 |
| $C_8F_{17}-SO_2-N(CH_2CH_2OH)-CH_2CH_2N^+(CH_3)_3$ | $Br^-$ | FK-18 |
| $C_8F_{17}SO_2N(H)-(CH_2)_3-N^+(CH_3)_3$ | $CH_3SO_3^-$ | FK-19 |
| $C_8F_{17}CH_2CH(OH)CH_2N^+(C_2H_4OH)_2-CH_3$ | $Cl^-$ | FK-20 |

In the invention, it is further desirable to use a hardly soluble sulfonamide type fluorine-containing cationic surfactant. The expression, "hardly soluble" herein means the case where a precipitate is produced or a suspended matter is observed after adding 2 g of the surfactant in 100 cc of $H_2O$ kept at 23° C., stirring the mixture for one hour and then allowing it to stand for 24 hours at 23° C. For example, FK-1, FK-8, FK-15, FK-16 and so forth may be corresponded to the fluorine-containing cationic surfactants. However, they shall not be limitative, but they may be selected in the foregoing tests.

The fluorine-containing anionic surfactants relating to the invention or the fluorine-containing cationic surfactants relating to the invention can be synthesized according to the processes described in, for example, U.S. Pat. Nos. 2,559,751, 2,567,011, 2,732,398, 2,764,602, 2,806,866, 2,809,998, 2,915,376, 2,915,528, 2,934,450, 2,937,098, 2,957,031, 3,472,894, 3,555,089 and 2,918,501; British Patent Nos. 1,143,927 and 1,130,822; JP Examined Publication No. 45-37304/1970; JP OPI Publication Nos. 47-9613/1972, 50-121243/1975, 50-117705/1975, 49-134614/1974, 50-117727/1975, 52-41182/1977 and 51-12392/1976; Journal of British Chemical Society, 1950, p.2789; ibid, 1957, pp.2574 & 1640; Journal of American Chemical Society, vol.79, p.2549, 1957; Journal of Japan Oil Chemists Society, vol.12, p.653; Journal of Organic Chemistry, vol.30, p.3524, 1965; and so forth.

Among the fluorine-containing surfactants relating to the invention, some of them are available on the market under the commercial brand names including, for example, Megafac F manufactured by Dai Nippon Chemical Industrial Co., Ltd., Fluorad FC, by Minnesota Mining and Manufacturing Co., Monflor, by Imperial Chemical Industry Co., Zonyls, by E. I. DuPont, Licowet VPF, by Hoechst A. G., respectively.

The fluorine-containing cationic surfactant and the fluorine-containing anionic surfactant may be used in a total amount within the range of, desirably, 0.1 to 1000 mg, more desirably 0.5 to 300 mg and, further desirably, 1.0 to 150 mg, per sq. meter of the photographic material of the invention. When making use of the fluorine-containing cationic surfactants and the fluorine-containing anionic surfactants in combination, two or more kinds of each of them may be used. Besides the above, it is also allowed to make combination use of a fluorine-containing nonionic surfactant, a fluorine-containing betaine surfactant and a hydrocarbon-containing surfactant. Further, the proportion of the fluorine-containing anionic surfactant and fluorine-containing cationic surfactant each of the invention added thereto may be, desirably 1:10 to 10:1 and, more desirably within the range of 3:7 to 7:3, each in mol ratios.

The fluorine-containing anionic surfactant and fluorine-containing cationic surfactant of the invention are added to a surface protective layer, the surface layer on a backing layer side or the surface layer of an intermediate product. It is also allowed to overcoat a compound relating to the invention over the surface layer of the above-mentioned light sensitive material or surface layer on the backing layer side thereof.

For displaying the effects of the invention most remarkably, it is desired to add the compounds of the invention to the surface layer, the surface layer on the backing layer side or the overcoated layer.

In the higher aliphatic acids (or the salts thereof) or the aliphatic hydrocarbon group-containing esters, which are applied in the invention to the outermost layer of a backing layer and represented by the foregoing Formula (A) or (B), it is desired to contain therein an aliphatic ester in which the aliphatic hydrocarbon groups have at least 24 carbon atoms in total.

Formula (A) RCOOM wherein R represents an aliphatic hydrocarbon group; and M represents, a hydrogen atom, a metal such as Na, K, Li, Mg, Ca, Sr and Ba, or $HN(R_2)_3$, or $N(R_2)_4$ (in which $R_2$ represents an alkyl group or a substituted alkyl group each having 1 to 18 carbon atoms). In the invention, however, the cations represented by M are desirable to be the others than hydrogen atom.

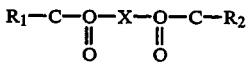

Formula (B)

wherein $R_1$ and $R_2$ represent each an aliphatic hydrocarbon group. It is desirable that each of them is to have 12 to 70 carbon atoms and the total carbon atoms of $R_1$ and $R_2$ are to be within the range of 24 to 140. It is more desirable that at least one of $R_1$ and $R_2$ represents a branched aliphatic hydrocarbon group having 12 carbon atoms and the total carbon atoms of $R_1$ and $R_2$ are to be within the range of 32 to 140. X represents a divalent bonding group.

The typically exemplified compounds represented by the foregoing Formula (A) or (B), each desirably applicable to the invention, will be given below. However, the invention shall not be limited thereto.

Exemplified compounds C

| | |
|---|---|
| $(n)C_{21}H_{43}COOC_{17}H_{35}(iso)$, | C-1 |
| $(n)C_{21}H_{43}COOC_{15}H_{31}(iso)$, | C-2 |
| $(n)C_{21}H_{43}COOC_{18}H_{37}(iso)$, | C-3 |
| $(n)C_{21}H_{43}COOC_{24}H_{49}(iso)$, | C-4 |
| $(iso)C_{17}H_{35}COOC_{32}H_{65}\frown C_{36}H_{73}(iso)$, | C-5 |

-continued

Exemplified compounds C

| | |
|---|---|
| $(n)C_{27}H_{55}COOC_{18}H_{37}(iso)$, | C-6 |
| $(n)C_{17}H_{35}COOC_{32}H_{65}\frown C_{36}H_{73}(iso)$, | C-7 |
| $(n)C_{21}H_{43}COOC_{16}H_{33}(iso)$, | C-8 |
| $(n)C_{21}H_{43}COOC_{20}H_{41}(iso)$, | C-9 |
| $(n)C_{23}H_{47}COOC_{24}H_{49}(iso)$, | C-10 |
| $(iso)C_{17}H_{35}COOC_{50}H_{101}(n)$, | C-11 |
| $(iso)C_{23}H_{47}COOC_{24}H_{49}(iso)$, | C-12 |
| $(iso)C_{31}H_{63}\frown C_{36}H_{71}COOC_{18}H_{37}(iso)$, | C-13 |
| $(n)C_{27}H_{55}COOC_{24}H_{49}(iso)$, | C-14 |
| $COOC_{24}H_{49}(iso)$<br>\|<br>$(CH_2)_2$<br>\|<br>$COOC_{24}H_{49}(iso)$ | C-15 |
| $COOC_{24}H_{49}\frown C_{26}H_{53}(iso)$<br>\|<br>$(CH_2)_4$<br>\|<br>$COOC_{24}H_{49}\frown C_{26}H_{53}(iso)$ | C-16 |
| $COOC_{32}H_{65}\frown C_{36}H_{73}(iso)$<br>\|<br>$(CH_2)_4$<br>\|<br>$COOC_{32}H_{65}\frown C_{36}H_{73}(iso)$ | C-17 |
| $COOC_{32}H_{65}\frown C_{36}H_{73}(iso)$<br>\|<br>$(CH_2)_8$<br>\|<br>$COOC_{32}H_{65}\frown C_{36}H_{73}(iso)$ | C-18 |
| $COOC_{24}H_{49}\frown C_{26}H_{53}(iso)$<br>\|<br>$(CH_2)_{10}$<br>\|<br>$COOC_{24}H_{49}\frown C_{26}H_{53}(iso)$ | C-19 |
| $COOC_{16}H_{33}(iso)$<br>\|<br>$(CH_2)_{12}$<br>\|<br>$COOC_{21}H_{43}(n)$ | C-20 |
| $COOC_{24}H_{49}\frown C_{26}H_{53}(iso)$<br>\|<br>$(CH_2)_{20}$<br>\|<br>$COOC_{24}H_{49}\frown C_{26}H_{53}(iso)$ | C-21 |
| $COOC_{24}H_{49}\frown C_{26}H_{53}(iso)$<br>\|<br>$(CH_2)_9$<br>\|<br>$CH-C_2H_5$<br>\|<br>$(CH_2)_6$<br>\|<br>$COOC_{24}H_{49}\frown C_{26}H_{53}(iso)$ | C-22 |
| $COOC_{32}H_{65}\frown C_{36}H_{73}(iso)$<br>\|<br>$(CH_2)_9$<br>\|<br>$CH-C_2H_5$<br>\|<br>$(CH_2)_6$<br>\|<br>$COOC_{32}H_{65}\frown C_{36}H_{73}(iso)$ | C-23 |

-continued
Exemplified compounds C
C-24
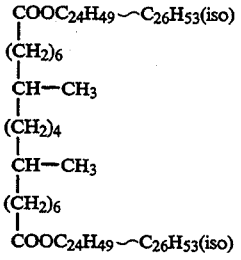
C-25
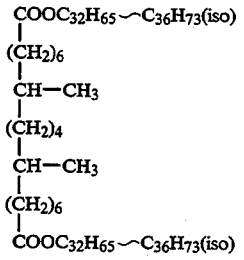
C-26
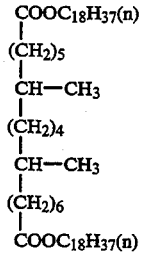
C-27
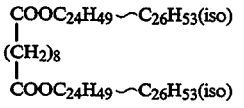
C-28
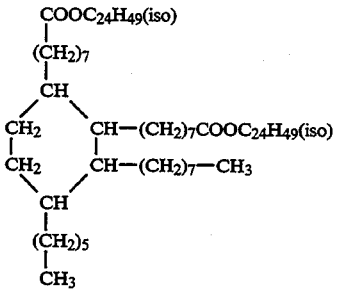
C-29
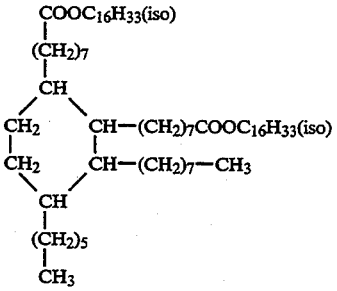
-continued
Exemplified compounds C
C-30
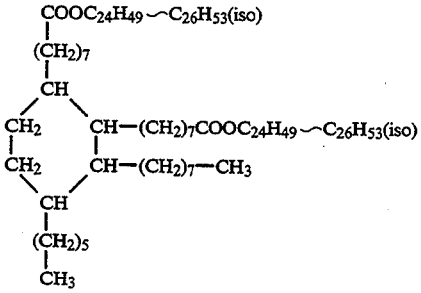
C-31
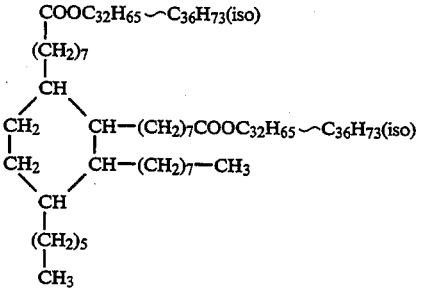
C-32 (iso)$C_{17}H_{35}COO(CH_2)_{14}OOCC_{17}H_{35}$(iso)
C-33 (iso)$C_{17}H_{35}COO(CH_2)_{20}OOCC_{17}H_{35}$(iso)
C-34 (iso)$C_{17}H_{35}COO(CH_2)_2CH(CH_3)(CH_2)_2OOCC_{21}H_{43}$(n)
C-35 (n)$C_{21}H_{43}COO(CH_2CH(CH_3)O)_{20}OOCC_{21}H_{43}$(iso)
C-36 (iso)$C_{27}H_{55}COO(CH_2CH(CH_3)O)_4OOCC_{27}H_{55}$(iso)
C-37 (iso)$C_{17}H_{35}COOCH_2CH_2SCH_2OOCC_{27}H_{53}$(n)
C-38
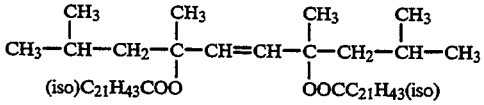
C-39
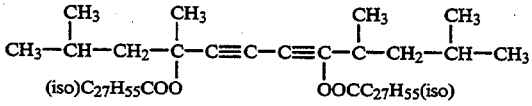
C-40 (iso)$C_{23}H_{47}COO(CH_2)_2OOCC_{23}H_{47}$(iso)
C-41 (iso)$C_{15}H_{31}COO(CH_2)_6OOCC_{21}H_{43}$(n)
C-42 (iso)$C_{31}H_{53}$ ⌒ $C_{35}H_{71}COO(CH_2)_4OOCC_{31}H_{63}$ ⌒ $C_{35}H_{71}$(iso)
C-43
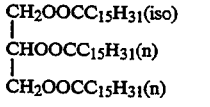
C-44
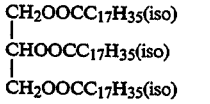
C-45
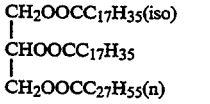

-continued

Exemplified compounds C $CH_2OOCC_{17}H_{35}(iso)$
$CHOOCC_{17}H_{35}(iso)$
$CH_2OOCC_{21}H_{43}(n)$ C-46

$CH_3-CH_2-C(CH_2OOCC_{17}H_{35}(iso))(CH_2OOCC_{21}H_{43}(n))(CH_2OOCC_{21}H_{43}(n))$ C-47

$CH_3-CH_2-C(CH_2OOCC_{17}H_{35}(iso))(CH_2OOCC_{17}H_{35}(n))(CH_2OOCC_{27}H_{55}(n))$ C-48

$(n)C_{21}H_{43}COOCH_2-C(CH_2OOCC_{17}H_{35}(iso))(CH_2OOCC_{17}H_{35}(iso))(CH_2OOCC_{21}H_{43}(n))$ C-49

$(n)C_{21}H_{43}COOCH_2-C(CH_2OOCC_{17}H_{35}(iso))(CH_2OOCC_{21}H_{43}(iso))(CH_2OOCC_{21}H_{43}(n))$ C-50

$(iso)C_{17}H_{35}COOCH_2-(CH)_4-CH_2OOCC_{17}H_{35}(iso)$ ($OOCC_{12}H_{25}(n)$) C-51

$(iso)C_{17}H_{35}COOCH_2-(CH)_4-CH_2OOCC_{17}H_{35}(iso)$ ($OOCC_{17}H_{35}(iso)$) C-52

$(n)C_{25}H_{51}COOC_{18}H_{37}(iso)$ C-53

$(n)C_{21}H_{43}COOC_{24}H_{49}(iso)$ C-54

$(iso)C_{17}H_{35}COOC_{32}H_{65}\sim C_{36}H_{73}(iso)$ C-55

$(n)C_{27}H_{35}COOC_{18}H_{37}(iso)$ C-56

$(n)C_{17}H_{35}COOC_{32}H_{65}\sim C_{36}H_{73}(iso)$ C-57

$(n)C_{21}H_{43}COOC_{16}H_{33}(iso)$ C-58

$(n)C_{21}H_{43}COOC_{20}H_{41}(iso)$ C-59

$(n)C_{21}H_{43}COOC_{24}H_{49}(iso)$ C-60

$(iso)C_{17}H_{35}COOC_{50}H_{101}(n)$ C-61

$(iso)C_{23}H_{47}COOC_{24}H_{49}(iso)$ C-62

$(iso)C_{31}H_{63}\sim C_{35}H_{71}COOC_{18}H_{37}(n)$ C-63

$(n)C_{27}H_{55}COOC_{24}H_{49}(iso)$ C-64

$(n)C_{15}H_{31}COOC_{16}H_{33}(n)$ C-65

$(n)C_{17}H_{35}COOC_{18}H_{37}(n)$ C-66

$(COOC_{32}H_{65}\sim C_{36}H_{73}(iso))_2(CH_2)_{10}$ C-67

$(COOC_{16}H_{33}(n))_2(CH_2)_{12}(COOC_{21}H_{43}(n))$ C-68

-continued

Exemplified compounds C $(COOC_{18}H_{37}(n))_2(CH_2)_2(COOC_{18}H_{37}(n))$ C-69

$(COOC_{16}H_{33}(n))_2(CH_2)_4(COOC_{16}H_{33}(n))$ C-70

$(COOC_{12}H_{25}(n))_2(CH_2)_8(COOC_{12}H_{25}(n))$ C-71

$(COOC_{21}H_{43}(n))_2(CH_2)_2O(CH_2)_2(COOC_{21}H_{43}(n))$ C-72

$(n)C_{17}H_{35}COONa$ C-73

$(n)C_{21}H_{43}COOH$ C-74

$(n)C_{21}H_{43}COONa$ C-75

$(n)C_{21}H_{43}COOHN(C_2H_5)_3$ C-76

$(n)C_{21}H_{43}COON(C_2H_5)_4$ C-77

$(n)C_{27}H_{55}COOK$ C-78

$(iso)C_{23}H_{47}COOH$ C-79

$(n)C_{15}H_{31}COOHN(C_8H_{17})_3$ C-80

$(n)C_{17}H_{35}COOH$ C-81

$(iso)C_{17}H_{35}COO\frac{1}{2}Ca$ C-82

$C_{21}H_{43}COOK$ C-83

$C_{21}H_{43}COOHN(C_2H_4OH)_3$ C-84

$C_{17}H_{35}COO\frac{1}{2}Ba$ C-85

$CH_3-CH(CH_3)-CH_2-C(CH_3)(OOCC_{21}H_{43}(n))-CH=CH-C(CH_3)(OOCC_{21}H_{43}(n))-CH_2-CH(CH_3)-CH_3$ C-86

$CH_3-CH(CH_3)-CH_2-C(CH_3)(OOCC_{27}H_{55}(n))-C\equiv C-C\equiv C(CH_3)(OOCC_{27}H_{55}(n))-C-CH_2-CH(CH_3)-CH_3$ C-87

$(n)C_{17}H_{35}COO(CH_2)_2OOCC_{17}H_{35}(n)$ C-88

$(n)C_{21}H_{43}COO(CH_2CH_2O)_2OCC_{21}H_{43}(n)$ C-89

$(n)C_{15}H_{31}COO(CH_2)_4OOCC_{15}H_{31}(n)$ C-90

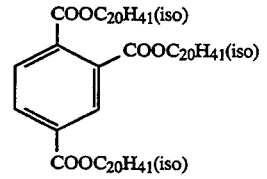

C-91

-continued

Exemplified compounds C

C-92

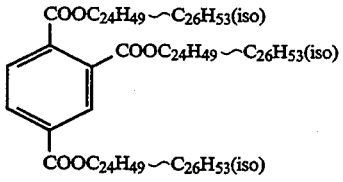

C-93

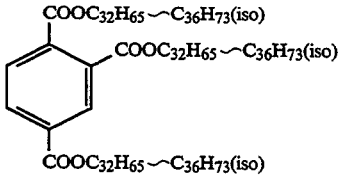

C-94

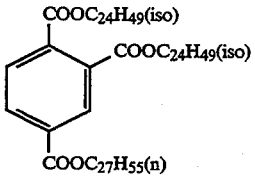

C-95

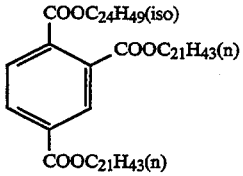

The above-mentioned compounds can be used upon dissolving them in a solvent including, for example, alcohols such as methanol and ethanol; ketones such as acetone and methylethyl ketone; ethers such as diethylether and dioxane; and aromatic hydrocarbons such as benzene and toluene.

The above-mentioned compounds may be used independently or in combination with a binder. The binders capable of being used in combination include, for example, the polymers or copolymers of polystyrene, polymethyl methacrylate, vinylidene polychloride, polyacrylonitrile and vinyl acetate; cellulose derivatives such as cellulose diacetate, cellulose nitrate; and acetals such as polyvinyl formal, polyvinyl acetal and polyvinyl benzal. The compounds shall not be limited thereto, provided, they have a coat-forming capability and are soluble to any solvents.

The compounds represented by Formula (A) or (B) may be used in an amount within the range of, desirably 1 to 500 mg and, more desirably 5 to 100 mg, each per sq. meter of a light sensitive material used.

The hydrophilic colloids applicable to the invention include, besides gelatin, for example, a gelatin derivative, a colloidal albumin, agar, gum arabic, alginic acid, a cellulose derivative such as cellulose acetate hydrolyzed to be 19 to 26% of an acetyl content, acrylamide, imidized polyacrylamide, casein, a vinyl alcohol polymer containing a urethane carboxylic acid group or a cyanoacetyl group such as vinyl alcohol and a vinyl cyanoacetate copolymer, polyvinyl alcohol, polyvinyl pyrrolidone, hydrolyzed polyvinyl acetate and a polymer prepared by polymerizing protein or saturated acylated protein and a monomer having a vinyl group.

In the invention and with the purpose of improving the physical properties of a coated layer comprising the above-mentioned hydrophilic colloids, it is desired if required to use various kinds of layer physical property improving agents such as a layer hardener. When making combination use of a layer hardener, for example, not only the synergistic effects can be displayed on the scratch prevention so-called in the invention, but also the mechanical strength of layers and the solubility resistance to solutions can be improved, so that a light sensitive material having remarkably excellent layer physical properties can be obtained.

When using gelatin as a hydrophilic colloid, the concrete examples of the typical layer hardeners may include those of aldehyde type, epoxy type, ethyleneimine type, carbodiimide type, mucochloric acid type and acyloyl type.

These gelatin hardeners applicable to the invention are described in, for example, U.S. Pat. Nos. 3,539,644, 3,642,486, 2,726,162, 2,816,125 and 3,047,394; West German Patent No. 1,085,663; British Patent No. 1,033,518; JP Examined Publication No. 48-3549/1973; PB Report No. 19921; U.S. Pat. Nos. 2,950,197, 2,964,404, 2,983,611, 3,271,175, 2,938,892, 3,640,720, 3,058,827 and 2,994,611; British Patent Nos. 822,061, 1,042,083, 1,2052,052 and 1,230,354; West German Patent No. 872,153; JP Examined Publication Nos. 44-29622/1969, 47-25373/1972, 47-8736/1972 and 46-38715/1971; JP OPI Publication Nos. 49-73122/1974, 49-24435/1974, 48-43319/1973 and 49-116154/1974; and JP Application Nos. 48-112325/1973, 48-110996/1973 and 49-15096/1974.

The layer hardeners may be used in any amount, provided that the effects of the invention cannot be spoiled so as to meet the kinds of subject gelatin layers, the physical properties required, and the photographic characteristics. However, it is desired that they are contained in an amount of not less than 0.01 wt % and, desirably, not less than 1 wt % of the dried amount of gelatin contained in the outermost layer and other hydrophilic colloidal layers of a light sensitive material of the invention.

The hydrophilic colloidal layers of the light sensitive materials of the invention may contain any other photographic additives than the above-mentioned layer hardeners, if required. The photographic additives include, for example, a gelatin plasticizer, a surfactant, a UV absorbent, an antistaining agent, a pH controller, an antioxidizer, an antistatic agent, a thickener, a graininess improver, a dye, a mordant, a whitening agent, a development speed controller and a matting agent. These additives may be used in any amounts, provided, the effects of the invention cannot be spoiled.

Among these various additives, those desirably applicable to the invention include in particular the following additives. For example, the thickeners or plasticizers include the substances given in U.S. Pat. No. 2,960,404, JP Examined Publication No. 43-4939/1968, West German Patent No. 1,904,604, JP OPI Publication No. 48-63715/1973, JP Examined Publication No. 45-15462/1969, Belgian Patent No. 762,833, U.S. Pat. No. 3,767,410 and Belgian Patent No. 588,143 and, particularly, a styrene-sodium maleate copolymer and dextran sulfate; the UV absorbents include the compounds given in JP Examined Publication No. 48-31255/1973, U.S. Pat. No. 3,253,921, British Patent No. 1,309,349, JP Examined Publication No. 48-31255/1973, U.S. Pat. No. 3,253,921 and British Patent No. 1,309,349 and, particularly, 2-(2'-hydroxy-5'-tert-butylphenyl)benzotriazole, 2-(2'-hydroxy-3',5'-di-tert-butylphenyl)benzotriazole, 2-(2'-hydroxy-3'-tert-butyl-5'-butylphenyl)-5-chlorobenzotriazole, 2-(2'-hydroxy-3',5-di-tert-butylphenyl)-5-chlorobenzene triazole; the surfactants include the compounds given in British Patent Nos. 548,532 and 1,216,389, U.S. Pat. Nos. 3,026,202 and 3,514,293, JP Examined Publication Nos. 44-26580/1969, 43-17922/1968, 43-17926/1968, 43-13166/1968 and 48-20785/1973, French Patent No. 202,585 and Belgian Patent No. 773,459 and, particularly, sodium-di-2-ethylhexyl sulfosuccinate, sodium-amyl-decyl sulfosuccinate, sodium dodecylbenzene sulfonate and sodium triisopropylnaphthalene sulfonate; the antistaining agents include the compounds given in U.S. Pat. Nos. 2,360,210, 2,728,659, 2,732,300 and 3,700,453 and, particularly, 2-methyl-5-hexadecylhydroquinone, 2-methyl-5-sec-octadecylhydroquinone and 2,5-di-tert-octyl hydroquinone; the antistatic agents include the compounds given in JP Examined Publication No. 46-24159/1971, JP OPI Publication No. 48-89979/1972,U.S. Pat. Nos. 2,882,157 and 2,972,535, JP OPI Publication Nos. 48-20785/1973, 48-43130/1973 and 48-90391/1973, JP Examined Publication Nos. 46-39312/1971, 48-43809/1073, 49-4853/1974, 49-64/1974 and 47-8742/1972 and JP OPI Publication No. 47-33627/1972; and the matting agents include the compounds given in U.S. Pat. Nos. 1,221,980, 2,992,101 and 2,956,884 and, particularly, silica gel having a particle size within the range of 0.5 to 20 μm and a polymethyl methacrylate polymer having a particle size within the range of 0.5 to 20 μm.

When the compounds represented by the foregoing Formula (A) or (B) are contained in the outermost layer of backing layers, it is allowed to contain, if required, a matting agent, a surfactant, a dye and so forth in the outermost layer of the backing layers.

As for the matting agents, the fine particles of silicon dioxide having an average particle size within the range of 0.01 to 10 μ may desirably be used. There is no special limitation to the various kinds of the above-mentioned additives and the preparation processes thereof. For example, the additives and the preparation processes thereof may be referred to the descriptions in Research Disclosure, vol. 176, pp.22~31, December 1978.

The methods applicable thereto for coating a layer containing the compounds represented by Formula (A) or (B) include, for example, any known methods such as a curtain-coating method, a reverse-roll coating method, a fountain-coating method, an air-doctor coating method, a slide-hopper coating method, an extrusion-coating method and a dip-coating method.

The silver halide emulsions applicable to the invention can be chemically sensitized in any ordinary methods. The chemical sensitization thereof can be performed with gold compounds, noble metal salts such as those of platinum, palladium, rhodium and iridium and, besides, stannous salts and amines.

The silver halide emulsions applicable to the invention can be added with a stabilizer or an antifoggant, which include various compounds such as many kinds of heterocyclic compounds, mercury-containing compounds, mercapto compounds and metal salts, as well as 4-hydroxy-6-methyl-1,3,3a,7-tetrazaindene and 3-methyl-benzothiazole, 1-phenyl-5-mercaptotetrazole.

The silver halide emulsions applicable to the invention can also be added with various spectrally sensitizing dyes so as to meet the objects. These spectrally sensitizing dyes include, for example, melocyanine dyes, carbocyanine dyes and cyanine dyes.

In the invention, the color couplers applicable thereto include, for example, 4-equivalent type methylene-containing yellow couplers, 2-equivalent type diketomethyl-containing yellow couplers, 4- or 2-equivalent type pyrazolone-containing magenta couplers, indazolone-containing magenta couplers, α-naphthol-containing cyan couplers and phenol-containing cyan couplers. Besides the above, the so-called DIR couplers may also be used therein.

The photographic component layers of the light sensitive materials of the invention can contain a dye, a UV absorbent and the layer hardeners and the surfactants such as those described before.

The supports applicable to the light sensitive materials of the invention include, for example, film supports each made of polyolefin (such as polyethylene), a cellulose derivative (such as polystyrene and cellulose triacetate) or a polyester (such as polyethylene terephthalate), or supports each made of a sheet of baryta paper, synthetic paper or paper coated on both sides with the above-mentioned polymer films and the analogues thereof.

The photographic component layers of the light sensitive materials of the invention can be coated one layer after another or multilayer-coated at the same time, in various methods such as a dip-coating method, an air-knife coating method, a curtain-coating method and an extrusion-coating method.

Various kinds of the additives, vehicles, supports, coating methods and so forth each applicable to the invention can be referred to the descriptions in Product Licensing Index, vol.92, pp.107~110, December 1971.

There is no special limitation to the exposure light sources for the light sensitive materials of the invention. Therefore, those having a low illuminance upto a high illuminance can be used for. As for the exposure time, it can be applied thereto within the range of the order of some tens seconds to $10^{-6}$ seconds.

The light sensitive materials of the invention are applicable to any one of black-and-white photographic light sensitive materials, color photographic light sensitive materials and those for general use, printing use, X-ray use and radiation use. To be more concrete, they are applicable to every silver halide photographic light sensitive material including, for example, black-and-white negative type film, paper and reflection type photographic light sensitive materials; color negative type film, paper and for reversal use; and the so-called coupler-in-developer type color photographic light sensitive materials containing color developing agents in processing solutions.

EXAMPLES

The illustrations of the effects of the invention will now be cited below.

In all the following examples, the amounts of the materials added to the silver halide photographic light sensitive materials shall be indicated by the numbers of grams per sq. meter, unless otherwise expressly stated. The amounts of silver halides and colloidal silver shall be indicated by converting them into the silver contents.

Example 1

A subbing process was applied to one side (of the surfaces) of a triacetyl cellulose film support and then the backing layers having the following compositions were each prepared, in order from the support side, on the surface (i.e., on a backing layer) opposite to the subbed surface with interposing the support between.

Backing layer 1

This layer was prepared by coating the following backing layer 1 coating solution in a proportion of 20 ml/m$^2$ and was then dried at 80° C. for 5 minutes.

| | |
|---|---|
| Alumina sol AS-100 (manufactured by Nissan Chemical Industries Co., Ltd.) | 40 g |
| Acetone | 500 ml |
| Methanol | 400 ml |
| Dimethyl formamide | 100 ml |

Backing layer 2

On the resulting backing layer 1, the following backing layer 2 coating solution was so coated as to be 20 ml/m$^2$ and was then dried up at 80° C. for 5 minutes.

| | |
|---|---|
| Diacetyl cellulose | 1 g |

-continued

| | |
|---|---|
| $SiO_2$ fine particles (having an average particle size of 3.0 μm) | 0.02 g |
| Acetone | 500 ml |
| Ethyl acetate | 500 ml |

Backing layer 3

On the resulting backing layer 2, the following backing layer 3 coating solution was so coated as to be 20 ml/m$^2$ and was then dried up at 90° C. for 5 minutes.

| | |
|---|---|
| Toluene | 700 ml |
| Methylethyl ketone | 300 ml |
| Compound contained in the backing layer (See Table 1) | 1 g |

Next, a multilayered color photographic light sensitive material was prepared by forming each of the layers having the following compositions, in order from the support side, on the surface side (i.e., on the emulsion layer side) of the support opposite to the backing layer.

| | |
|---|---|
| Layer 1: Antihalation layer (HC) | |
| Black colloidal silver | 0.15 |
| UV absorbent (UV-1) | 0.20 |
| Colored Cyan coupler (CC-1) | 0.02 |
| High boiling solvent (Oil-1) | 0.20 |
| High boiling solvent (Oil-2) | 0.20 |
| Gelatin | 1.6 |
| Layer 2: Intermediate layer (IL-1) | |
| Gelatin | 1.3 |
| Layer 3: Low-speed red-sensitive emulsion layer (R-L) | |
| Silver iodobromide emulsion, (having an average grain size of 0.3 μm and an average iodine content of 2.0 mol %) | 0.4 |
| Silver iodobromide emulsion, (having an average grain size of 0.4 μm and an average iodine content of 8.0 mol %) | 0.3 |
| Sensitizing dye (S-1) | $3.2 \times 10^{-4}$ (mols/mol of Ag) |
| Sensitizing dye (S-2) | $3.2 \times 10^{-4}$ (mols/mol of Ag) |
| Sensitizing dye (S-3) | $0.2 \times 10^{-4}$ (mols/mol of Ag) |
| Cyan coupler (C-1) | 0.50 |
| Cyan coupler (C-2) | 0.13 |
| Colored cyan coupler (CC-1) | 0.07 |
| DIR compound (D-1) | 0.006 |
| DIR compound (D-2) | 0.01 |
| High boiling solvent (Oil-1) | 0.55 |
| Additive (SC-1) | 0.003 |
| Gelatin | 1.0 |
| Layer 4: High-speed red-sensitive emulsion layer (R-H) | |
| Silver iodobromide emulsion, (having an average grain size of 0.7 μm and an average iodine content of 7.5 mol %) | 0.9 |
| Sensitizing dye (S-1) | $1.7 \times 10^{-4}$ (mols/mol of Ag) |
| Sensitizing dye (S-2) | $1.6 \times 10^{-4}$ (mols/mol of Ag) |
| Sensitizing dye (S-3) | $0.1 \times 10^{-4}$ (mols/mol of Ag) |
| Cyan coupler (C-2) | 0.23 |
| Colored cyan coupler (CC-1) | 0.03 |
| DIR compound (D-2) | 0.02 |
| High boiling solvent (Oil-1) | 0.25 |
| Additive (SC-1) | 0.003 |
| Gelatin | 1.0 |
| Layer 5: Intermediate layer (IL-2) | |
| Gelatin | 0.8 |
| Layer 6: Low-speed green-sensitive emulsion layer (G-L) | |
| Silver iodobromide emulsion, (having an average grain size of 0.4 μm and an average iodine content of 8.0 mol %) | 0.6 |

-continued

| | |
|---|---|
| Silver iodobromide emulsion, (having an average grain size of 0.3 μm and an average iodine content of 2.0 mol %) | 0.2 |
| Sensitizing dye (S-4) | $6.7 \times 10^{-4}$ (mols/mol of Ag) |
| Sensitizing dye (S-5) | $0.8 \times 10^{-4}$ (mols/mol of Ag) |
| Magenta coupler (M-1) | 0.17 |
| Magenta coupler (M-2) | 0.43 |
| Colored magenta coupler (CM-1) | 0.10 |
| DIR compound (D-3) | 0.02 |
| High boiling solvent (Oil-2) | 0.70 |
| Additive (SC-1) | 0.003 |
| Gelatin | 1.0 |
| Layer 7: High-speed green-sensitive emulsion layer (G-H) | |
| Silver iodobromide emulsion, (having an average grain size of 0.7 μm and an average iodine content of 7.5 mol %) | 0.9 |
| Sensitizing dye (S-6) | $1.1 \times 10^{-4}$ (mols/mol of Ag) |
| Sensitizing dye (S-7) | $2.0 \times 10^{-4}$ (mols/mol of Ag) |
| Sensitizing dye (S-8) | $0.3 \times 10^{-4}$ (mols/mol of Ag) |
| Magenta coupler (M-1) | 0.03 |
| Magenta coupler (M-2) | 0.13 |
| Colored magenta coupler (CM-1) | 0.04 |
| DIR compound (D-3) | 0.004 |
| High boiling solvent (Oil-2) | 0.35 |
| Gelatin | 1.0 |
| Layer 8: Yellow filter layer (YC) | |
| Yellow colloidal silver | 0.1 |
| Additive (HS-1) | 0.07 |
| Additive (HS-2) | 0.07 |
| High boiling solvent (Oil-2) | 0.15 |
| Gelatin | 1.0 |
| Layer 9: Low-speed blue-sensitive emulsion layer (B-L) | |
| Silver iodobromide emulsion, (having an average grain size of 0.3 μm and an average iodine content of 2.0 mol %) | 0.25 |
| Silver iodobromide emulsion, (having an average grain size of 0.4 μm and an average iodine content of 8.0 mol %) | 0.25 |
| Sensitizing dye (S-9) | $5.8 \times 10^{-4}$ (mols/mol of Ag) |
| Yellow coupler (Y-1) | 0.60 |
| Yellow coupler (Y-2) | 0.32 |
| DIR compound (D-1) | 0.003 |
| DIR compound (D-2) | 0.006 |
| High boiling solvent (Oil-2) | 0.18 |
| Gelatin | 1.3 |
| Layer 10: High-speed blue-sensitive emulsion layer (B-H) | |
| Silver iodobromide emulsion, (having an average grain size of 0.8 μm and an average iodine content of 8.5 mol %) | 0.5 |
| Sensitizing dye (S-10) | $3.0 \times 10^{-4}$ (mols/mol of Ag) |
| Sensitizing dye (S-11) | $1.2 \times 10^{-4}$ (mols/mol of Ag) |
| Yellow coupler (Y-1) | 0.18 |
| Yellow coupler (Y-2) | 0.10 |
| High boiling solvent (Oil-2) | 0.05 |
| Gelatin | 1.0 |
| Layer 11: Protective layer 1 (PRO-1) | |
| Silver iodobromide, (having an average grain size of 0.08 μm and an average iodine content of 1.0 mol %) | 0.3 |
| UV absorbent (UV-1) | 0.07 |
| UV absorbent (UV-2) | 0.1 |
| Additive (HS-1) | 0.2 |
| Additive (HS-2) | 0.1 |
| High boiling solvent (Oil-1) | 0.07 |
| High boiling solvent (Oil-3) | 0.07 |
| Gelatin | 0.8 |
| Layer 12: Protective layer 2 (PRO-2) | |
| Compound contained in the protective layer (See Table 1) Total (mol ratio 1:1) | 0.01 |
| Polymethyl methacrylate, (having an average particle size of 3 μm) | 0.02 |
| Copolymer of methyl methacrylate: ethyl methacrylate: methacrylic acid = 3:3:4 (in wt ratio), (having an average particle size of 3 μm) | 0.13 |

-continued

| | |
|---|---|
| Gelatin | 0.5 |

The silver iodobromide emulsion used in Layer 10 was prepared in the following process.

The silver iodobromide emulsion was prepared, in a double-jet process, by making use of the monodisperse type silver iodobromide grains having an average grain size of 0.33 μm (and having a silver iodide content of 2 mol %) as the seed grains.

While keeping solution <G-1%> to be a temperature of 70° C., a pAg of 7.8 and a pH of 7.0 and stirring, it was added with a seed emulsion equivalent to 0.34 mols. (Formation of an internal high iodine phase —a core phase—)

After then, with keeping the flow rate of <H-1> to <S-1> to be 1:1, the resulting mixture was added by taking 86 minutes at an accelerated flow rate (i.e., the final flow rate was 3.6 times as fast as the initial flow rate.)

(Formation of an external low iodine phase —a shell phase—)

Successively, with keeping the pAg and pH at 10.1 and 6.0, respectively, <H-2> and <S-2> were added by taking 65 minutes at the flow rates accelerated by the flow rate of 1:1 (i.e., the final flow rate was 5.2 times as fast as the initial flow rate.)

The pAg and pH in the course of forming grains were controlled with an aqueous potassium bromide solution and an aqueous 56% acetic acid solution. After completing the grains, they were washed in an ordinary flocculation method and were then redispersed by adding gelatin, so that the pAg and pH were adjusted to be 8.06 and 5.8 at 40° C., respectively.

The resulting emulsion was proved to be a monodisperse type emulsion containing octahedral silver iodobromide grains having an average grain size of 0.80 μm, a distribution range of 12.4$ and a silver iodide content of 8.0 mol %.

| | |
|---|---|
| <G-1> | |
| Osein gelatin | 100.0 g |
| A 10 wt % methanol solution containing compound-[I] | 25.0 ml |
| An aqueous 28% ammoniacal solution | 440.0 ml |

-continued

| | |
|---|---|
| An aqueous 56% acetic acid solution | 660.0 ml |
| Add water to make | 5000.0 ml |
| <H-1> | |
| Osein gelatin | 82.4 g |
| Potassium bromide | 151.6 g |
| Potassium iodide | 90.0 g |
| Add water to make | 1030.5 ml |
| <S-1> | |
| Silver nitrate | 309.2 g |
| An aqueous 28% ammoniacal solution | An equivalent amount |
| Add water to make | 1030.5 ml |
| <H-2> | |
| Osein gelatin | 302.1 g |
| Potassium bromide | 770.0 g |
| Potassium iodide | 33.2 g |
| Add water to make | 3776.8 ml |
| <S-2> | |
| Silver nitrate | 1130.0 g |
| An aqueous 28% ammoniacal solution | An equivalent amount |
| Add water to make | 3776.8 ml |

The average grain size of the seed grains, the temperature, the pAg and pH, the flow rate, the adding time and the halide compositions of the seed grains were each varied in the same manner as in the above, so that each of the emulsions having the different average grain sizes and the silver iodide contents could be prepared.

Each of the resulting every emulsions was proved to be the core/shell type monodispersed emulsion having a distribution range of not wider than 20%. Each of the emulsions was subjected to the optimum chemical sensitization in the presence of sodium thiosulfate, chloroauric acid and ammonium thiocyanate and was then added with sensitizing dyes and 4-hydroxy-6-methyl-1,3,3a,7-tetrazaindene-1-phenyl-5mercaptotetrazole.

Further, the resulting light sensitive material samples each contained compounds Su-1 and Su-2, a viscosity controller, layer hardeners H-1 and H-2, stabilizer ST-1, antifoggants AF-1 and AF-2 (having weight average molecular weights of 10000 and 1100000, respectively), dyes AI-1 and AI-2 and compound DI-1 (in an amount of 9.4/m²).

C-1

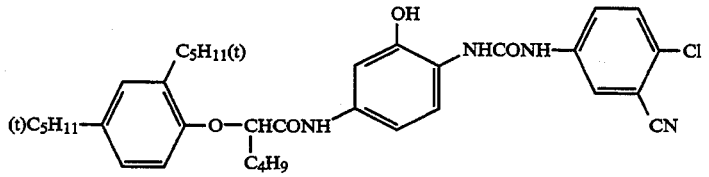

C-2

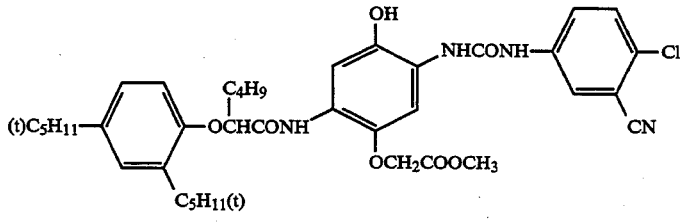

-continued
M-1
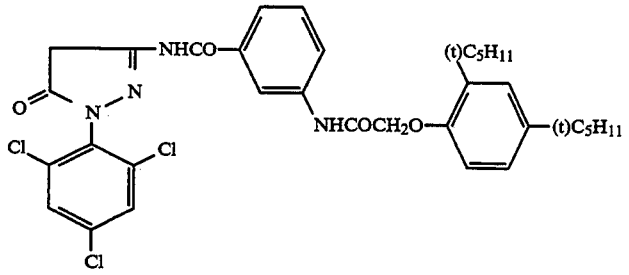
M-2
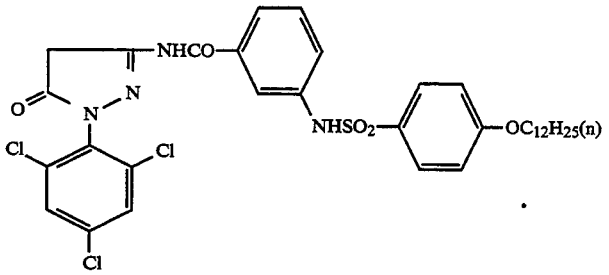
Y-1
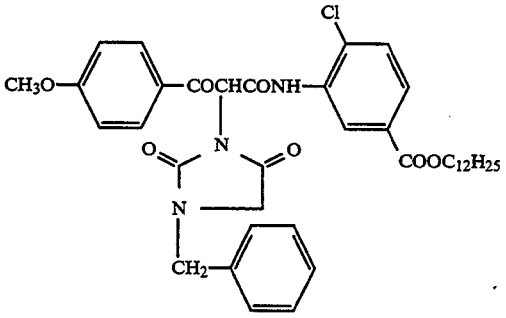
Y-2
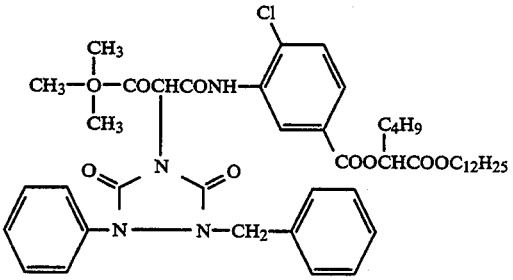
CC-1
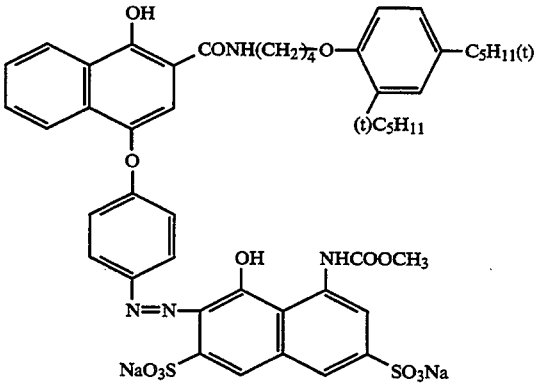

-continued
CM-1
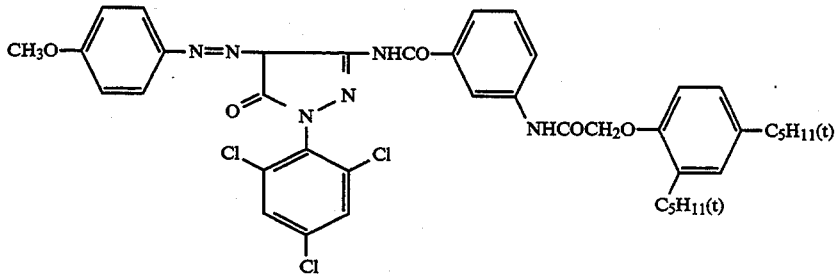
D-1
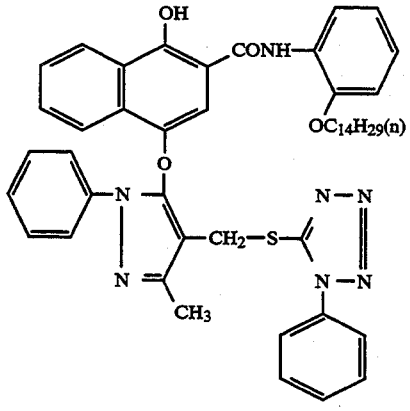
D-2
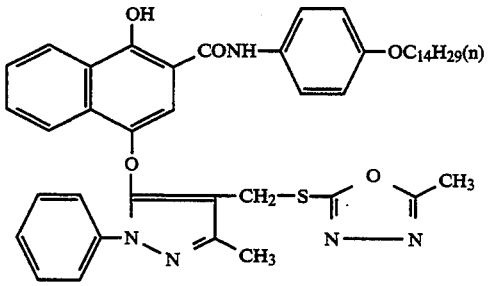
D-3
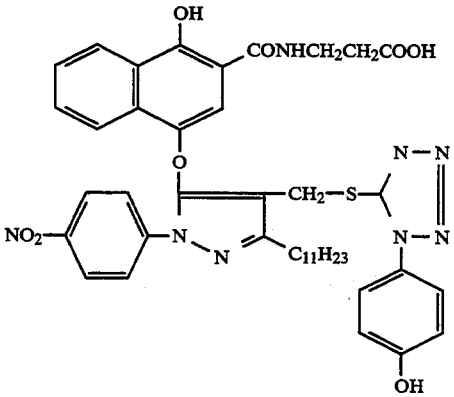
UV-1
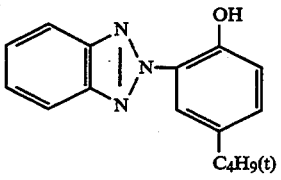

-continued
UV-2
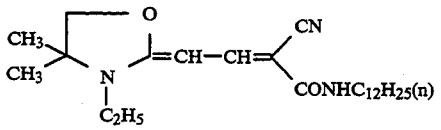
S-1
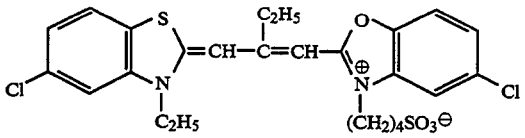
S-2
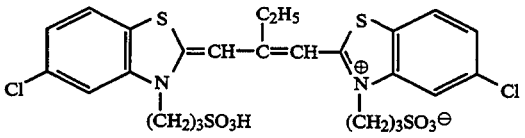
S-3
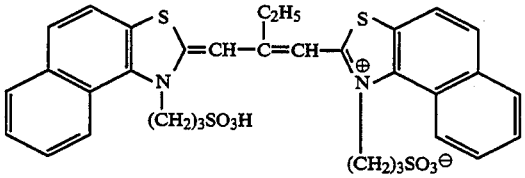
S-4
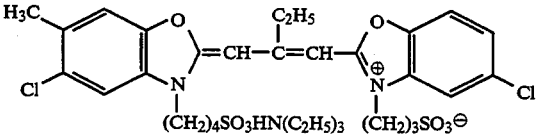
S-5
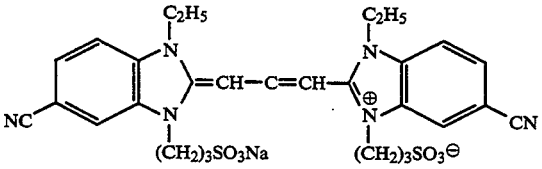
S-6
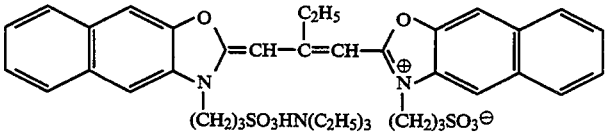
Compound [1]
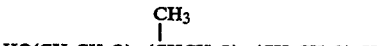
(Weight average molecular weight ≈ 1300)
S-7
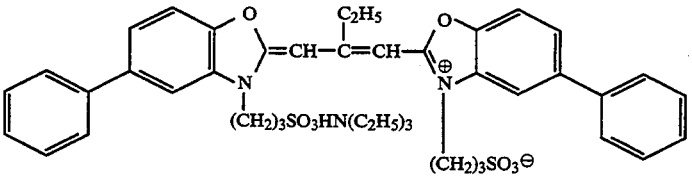
S-8
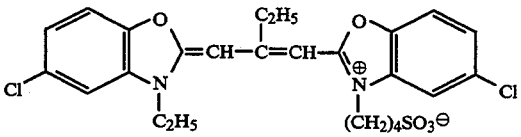

-continued
S-9
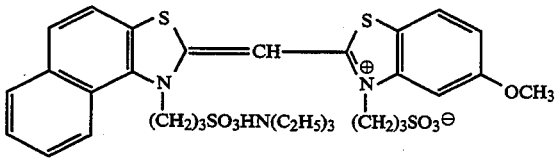
S-10
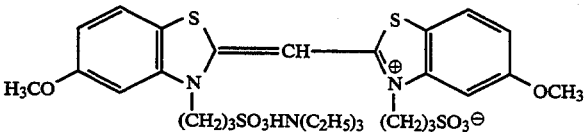
S-11
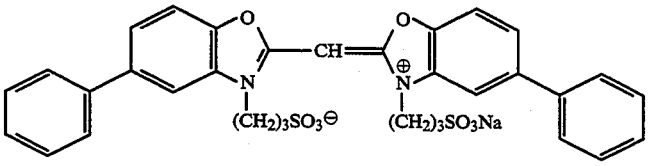
HS-1
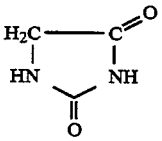
HS-2
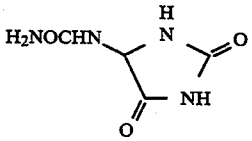
SC-2
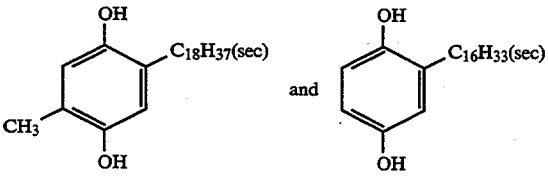
(A mixture having a ratio of 2:3)
Oil-1
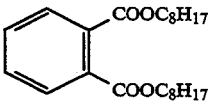
Oil-2
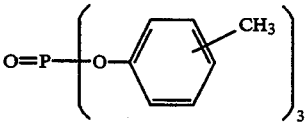
Oil-3
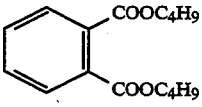
H-1
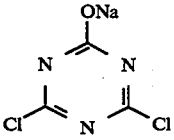
H-2
$(CH_2{=}CHSO_2CH_2)_2O$ -continued Su-1

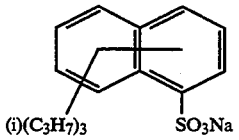

SU-2

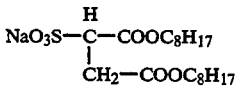

AI-1

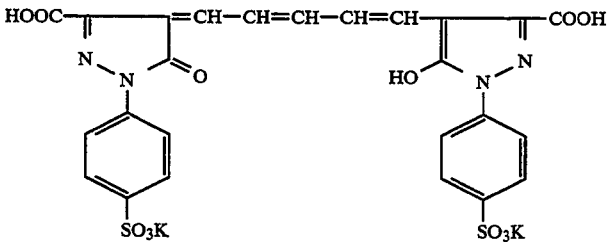

AI-2

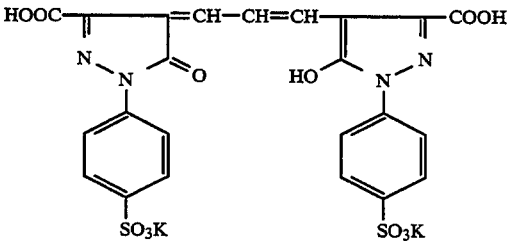

ST-1

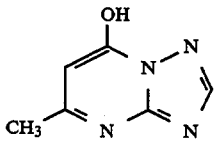

AF-1

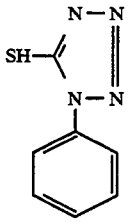

AF-2

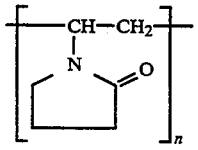

D-1

(A mixture of the following three components)

[A] [B] [C]

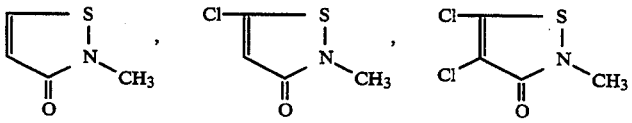

Components [A]:[B]:[C] = 46:50:4 (in mol ratio)

(Method for measuring a pressure fog)

The sample was prepared in a dark room and then cut into a size of 35 mm ×111 mm. The cut piece of the sample was loaded in a cartridge (of a current type) having an inner diameter of 22 mm. In the state where the sample-loaded cartridge was loaded in Konica Camera FT-1 (manufactured by Konica Corp.), a forced aging test was carried out (at 23° C. and 80% RH for one day).

After then, the whole light sensitive material sample was wound up. Next, the light sensitive material sample was developed in the following processing steps and the resulting pressure fog was evaluated.

The yellow density of the resulting spot-like fog and the unfogged portions on the leading edge side of the sample were measured by a microdensitometer. From the measurement results, the density difference ΔD was obtained and was then evaluated in the following criteria.

O : 0~0.06, Δ: 0.07~0.12, X: 0.12~0.19, XX: 0.20 or more

The samples prepared in the above-described manner were exposed wedgewise to white light and were then developed.

| Processing step A | Processing time | Processing temperature | Amount replenished |
|---|---|---|---|
| Color developing | 3 min. 15 sec | 38° C. | 780 ml |
| Bleaching | 45 sec | 38° C. | 150 ml |
| Fixing | 1 min. 30 sec | 38° C. | 830 ml |
| Stabilizing | 60 sec | 38° C. | 830 ml |
| Drying | 1 min. | 55° C. | — |

(The amounts replenished were indicated by the values per sq. meter of the subject light sensitive materials.)

The stabilizing step was carried out in a three-tank-cascade system.

| | |
|---|---|
| Color developer | |
| Water | 800 ml |
| Potassium carbonate | 30 g |
| Sodium hydrogen carbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-N-(β-hydroxylethyl) aniline sulfate | 4.5 g |
| Diethylenediamine pentaacetate | 3.0 g |
| Potassium hydroxide | 1.2 g |
| Add water to make | 1 liter |
| Adjust pH with potassium hydroxide or a 20% sulfuric acid solution to be | pH 10.06 |
| Color developer replenisher | |
| Water | 800 ml |
| Potassium carbonate | 35 g |
| Sodium hydrogen carbonate | 3 g |
| Potassium sulfite | 5 g |
| Sodium bromide | 0.4 g |
| Hydroxylamine sulfate | 3.1 g |
| 4-amino-3-methyl-N-ethyl-N-(β-hydroxylethyl) aniline sulfate | 6.3 g |
| Potassium hydroxide | 2 g |
| Diethylenediamine pentaacetate | 3 g |
| Add water to make | 1 liter |
| Adjust pH with potassium hydroxide or a 20% sulfuric acid solution to be | pH 10.18 |
| Bleacher | |
| Water | 700 ml |
| Ferric ammonium 1,3-diaminopropane tetraacetate | 175 g |
| Disodium ethylenediamine tetraacetate | 2 g |
| Sodium nitrate | 50 g |
| Ammonium bromide | 150 g |
| Glacial acetic acid | 40 g |
| Add water to make | 1 liter |
| Adjust pH suitably with aqueous ammonia or glacial acetic acid to be | pH 4.4 |
| Bleacher replenisher | |
| Water | 700 ml |
| Ferric ammonium 1,3-diaminopropane tetraacetate | 180 g |
| Disodium ethylenediamine tetraacetate | 2 g |

-continued

| | |
|---|---|
| Sodium nitrate | 50 g |
| Ammonium bromide | 200 g |
| Glacial acetic acid | 56 g |
| Adjust pH with aqueous ammonia or glacial acetic acid to be | pH 4.0 |
| Add water to make | 1 liter |
| Fixer | |
| Water | 800 ml |
| Ammonium thiosulfate | 150 g |
| Ammonium thiocyanate | 120 g |
| Sodium sulfite | 15 g |
| Disodium ethylenediamine tetraacetate | 2 g |
| Adjust pH with acetic acid and aqueous ammonia to be | pH 6.2 |
| Add water to make | 1 liter |
| Fixer replenisher | |
| Water | 800 ml |
| Ammonium thiosulfate | 180 g |
| Ammonium thiocyanate | 150 g |
| Sodium sulfite | 20 g |
| Disodium ethylenediamine tetraacetate | 2 g |
| Adjust pH with acetic acid and aqueous ammonia to be | pH 6.5 |
| Add water to make | 1 liter |
| Stabilizer & stabilizer replenisher | |
| 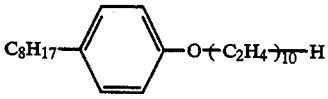 | 2.0 g |
| Dimethylol urea | 0.5 g |
| Hexamethylene tetramine | 0.2 g |
| 1,2-benzisothiazoline-3-one | 0.1 g |
| Siloxane (L-77 manufactured by UCC) | 0.1 g |
| Aqueous ammonia | 0.5 ml |
| Add water to make | 1 liter |
| Adjust pH with aqueous ammonia and a 50% sulfuric acid solution to be | pH 8.5 |

Finger-print smudge resistance

The evaluation method is as follows:

Each of the samples was cut into a film strip (a 24-exposure film) measuring 35×117 mm which was put in a cartridge having an inner diameter of 22 mm after being wound around a spool having an outer diameter of 11 mm. Each sample was subjected to moisture treatment for 5 hours under the conditions of 25° C. in temperature and 70% RH in relative humidity. A tester, on the other hand, washed his hands well with a neutral detergent (10% aqueous solution), rinsed with water, and dried with a dryer. After that, he put on cotton gloves and kept them on for 1 hour. Then, the took off the gloves and put his hand on the sample naturally as far as possible and applied a load of 1 kg on his hand for 30 seconds to mark a fingerprint on the sample. After 20 minutes, the marked fingerprint was tried to be wiped off with a cloth. Then, a remaining fingerprint on each of the samples was observed and evaluated by three evaluators as follows:

◎ Finger-print was wiped off completely,

○ Finger-print was almost wiped off, but remained faintly,

Δ Finger-print remained a half or more,

X Finger-print could not be wiped off at all, (with scratches)

Kinematic friction coefficient measurement method

The kinematic friction coefficient to the velvet of the backing outermost layer of a subject sample was measured by making use of a Nylon-made 1-cm$^2$-sized velvet to which a 100 g load was applied under the conditions of a speed at 10 cm/minute, (provided, however, the temperature was 23° C. and the humidity was 55%.)

The results thereof will be shown in Table 1.

Adhesion resistance evaluation method

A sample was cut into two pieces each having a size of 5cm$^2$. The cut pieces were stored for one day in an atmosphere at 23° C. and 80% RH so as not to come into contact with each other. The protective layers of the two pieces of one and the same sample were brought into contact with each other and were then applied with a load of 800 g. They were stored for three days in an atmosphere at 40° C. and 80% RH. After that, the sample was peeled off and the area of the adhered portion was measured, so that the adhesion resistance thereof was measured. The evaluation criteria were as follows.

| Rank | Adhesion area |
|---|---|
| A | 0 to less than 10% |
| B | 10 to less than 20% |
| C | 20 to less than 40% |
| D | 40 to less than 60% |
| E | 60% or more |

High humidity slidability measurement method

The high humidity slidability of the outermost layer on the emulsion side of a sample was evaluated in terms of a kinematic friction coefficient to the outermost backing layer of Sample (I-1) cut into a 1 cm$^2$ size.

The above-mentioned measurement was carried out in the conditions that a load of 50 g was applied and a speed was at a rate of 10 cm/minute. (provided, the temperature was 23° C. and the humidity was 92% RH.)

Scratch resistance measurement

A 35 mm×117 cm sized film (for 24 ex.) was stored in a cartridge having an inner diameter of 22 mm, wound around a spool having an outer diameter of 11 mm and was then forcibly aged (at 55° C. for one day). After that, some suitably amount of sand were sprinkled over the backing layer side of the film in the velvet portion of the cartridge and the film was then pulled out at a speed of 20 cm/second. The scratches resulted on the backing layer surface of the film were evaluated according to the following criteria.

Criteria for evaluating scratch resistance:

O: No scratch was found at all,

Δ: Few scratches were found,

X: Serious scratches were found.

Antistaticity measurement

Antistaticity was graded by measuring the static mark productions. The static mark production test was tried in the method that the surface of the emulsion layer side of an unexposed light sensitive material subject to the test was put downward on a rubber sheet and they were contacted with pressure by a rubber roller. After that, they were peeled off from each other so that static marks could be produced. The test was tried in an atmosphere at 25° C. and 25% RH. The rehumidification of the test pieces were carried out for 24 hours in the foregoing conditions.

The evaluation was made in accordance with the following 5 ranks.

A: No static mark production was found,

B: Few static mark production were found,

C: Considerable static mark production were found,

D: Serious static mark production were found,

E: Static mark production were found on the whole surface.

The results of the above-mentioned various evaluation will be shown in Table 1.

TABLE 1

| Sample | Emulsion layer 12: Fluorine-containing anionic surfactant | Emulsion layer 12: Fluorine-containing cationic surfactant | Backing layer 3 Higher aliphatic acid or higher aliphatic ester | Pressure fog | Finger-print adhesion* | Kinematic friction coefficient | Scratch resistance | Anti-staticity (Static mark) | Adhesion resistance | High humidity slidability | Remarks |
|---|---|---|---|---|---|---|---|---|---|---|---|
| I-1 | — | — | — | XX | X | 0.39 | X | C | E | 0.42 | Comp. |
| I-2 | FA-16 | — | C-2 | XX | X | 0.22 | ○ | B | D | 0.35 | Comp. |
| I-3 | — | FK-4 | C-2 | Δ | X | 0.22 | ○ | B | C | 0.30 | Comp. |
| I-4 | FA-16 | FK-4 | — | Δ | X | 0.39 | X | A | A | 0.22 | Comp. |
| I-5 | FA-15 | — | — | XX | X | 0.39 | X | B | D | 0.39 | Comp. |
| I-6 | FA-16 | FK-4 | C-2 | ○ | ◎ | 0.22 | ○ | A | A | 0.22 | Inv. |
| I-7 | FA-19 | FK-8 | C-10 | ○ | ◎ | 0.23 | ○ | A | A | 0.23 | Inv. |
| I-8 | FA-15 | FK-13 | C-14 | ○ | ◎ | 0.23 | ○ | A | A | 0.22 | Inv. |
| I-9 | FA-18 | FK-15 | C-26 | ○ | ◎ | 0.22 | ○ | A | A | 0.24 | Inv. |
| I-10 | FA-27 | FK-5 | C-49 | ○ | ◎ | 0.22 | ○ | A | A | 0.22 | Inv. |
| I-11 | FA-20 | FK-16 | C-75 | ○ | ◎ | 0.22 | ○ | A | A | 0.22 | Inv. |
| I-12 | FA-34 | FK-17 | C-80 | ○ | ◎ | 0.23 | ○ | A | A | 0.23 | Inv. |
| I-13 | FA-41 | FK-19 | C-82 | ○ | ◎ | 0.23 | ○ | A | A | 0.22 | Inv. |

Comp.: Comparison Inv.: Invention

*The three evaluators gave same results.

As is obvious from Table 1, it was proved that the finger-print adhesion, the pressure fog produced at a high humidity and, particularly, in a high humidity and high temperature atmosphere, the adhesion resistance, the antistaticity and so forth can remarkably be improved when making combination use of a fluorine-containing anionic surfactant and a fluorine-containing cationic surfactant in the outermost layer and, at the same time, when making use of a higher aliphatic acid (or the salt thereof) or an aliphatic hydrocarbon group-containing ester in the outermost layer of the backing layers.

Example 2

Samples were each prepared in the same manner as in Example 1.

The amounts added and mixing ratios each of the fluorine-containing anionic surfactant and fluorine-containing cationic surfactant, and the amounts added of the higher aliphatic acid (or the salt thereof) or the aliphatic hydrocarbon group-containing ester were as follows.

Table 2 shows the results of the kinematic friction coefficients, scratch resistance, antistaticity, adhesion resistance, finger-print adhesion on high humidity slidability and pressure fog.

TABLE 2

| Sample | Emulsion layer 12: Fluorine-containing anionic surfactant | Fluorine-containing cationic surfactant | Anion: cation (in mol ratio), [Total amts added (mg/m²)] | Higher aliphatic acid or higher aliphatic ester (mg/m²) | Pressure fog | Finger-print adhesion* | Kinematic friction coefficient | Scratch resistance | Antistaticity (Static mark) | Adhesion resistance | High humidity slidability | Remarks |
|---|---|---|---|---|---|---|---|---|---|---|---|---|
| II-1 | — | — | — | — | XX | X | 0.39 | X | C | E | 0.42 | Comp. |
| II-2 | — | — | — | C-3(20.0) | XX | X | 0.23 | ○ | C | E | 0.42 | Comp. |
| II-3 | — | FK-5 | 0:1(10.0) | — | X | X | 0.39 | X | B | C | 0.22 | Comp. |
| II-4 | FA-15 | — | 1:0(10.0) | — | XX | X | 0.39 | X | B | D | 0.35 | Comp. |
| II-5 | FA-15 | FK-5 | 1:1(10.0) | — | Δ | X | 0.39 | X | A | A | 0.23 | Comp. |
| II-6 | FA-15 | FK-5 | 1:1(5.0) | C-20(20.0) | ○ | ◎ | 0.23 | ○ | A | A | 0.23 | Inv. |
| II-7 | FA-15 | FK-5 | 1:1(10.0) | C-20(20.0) | ○ | ◎ | 0.23 | ○ | A | A | 0.23 | Inv. |
| II-8 | FA-15 | FK-5 | 1:1(15.0) | C-20(20.0) | ○ | ◎ | 0.23 | ○ | A | A | 0.23 | Inv. |
| II-9 | FA-22 | FK-13 | 3:7(10.0) | C-26(20.0) | ○ | ◎ | 0.22 | ○ | A | A | 0.22 | Inv. |
| II-10 | FA-22 | FK-13 | 1:1(10.0) | C-26(20.0) | ○ | ◎ | 0.22 | ○ | A | A | 0.22 | Inv. |
| II-11 | FA-22 | FK-13 | 7:3(10.0) | C-26(20.0) | ◎ | ○ | 0.22 | ○ | A | A | 0.22 | Inv. |
| II-12 | FA-19 | FK-8 | 3:7(5.0) | C-33(20.0) | ○ | ◎ | 0.22 | ○ | A | A | 0.23 | Inv. |
| II-13 | FA-19 | FK-8 | 1:1(10.0) | C-33(20.0) | ○ | ◎ | 0.22 | ○ | A | A | 0.23 | Inv. |
| II-14 | FA-19 | FK-8 | 7:3(15.0) | C-33(20.0) | ○ | ◎ | 0.22 | ○ | A | A | 0.23 | Inv. |
| II-15 | FA-26 | FK-20 | 1:1(10.0) | C-45(10.0) | ○ | ◎ | 0.23 | ○ | A | A | 0.22 | Inv. |
| II-16 | FA-26 | FK-20 | 1:1(10.0) | C-45(20.0) | ○ | ◎ | 0.23 | ○ | A | A | 0.22 | Inv. |
| II-17 | FA-26 | FK-20 | 1:1(10.0) | C-45(30.0) | ○ | ◎ | 0.23 | ○ | A | A | 0.22 | Inv. |

Comp.: Comparison Inv.: Invention
*The three evaluators gave same results.

As is obvious from Table 2, when a sample was applied with a fluorine-containing anionic surfactant and a fluorine-containing cationic surfactant each in a desirable mixing ratio and in a desirable amounts added to the outermost layer and also applied with a higher aliphatic acid (or the salt thereof) or an aliphatic hydrocarbon group-containing ester in a desirable amount, the resulting sample can remarkably be improved in the finger-print adhesion, pressure fog production at a high humidity and, particularly, in a high temperature and high humidity atmosphere, the adhesion resistance, the antistaticity and so forth.

Example 3

The emulsion side of a sample was prepared in the same manner as in Example 1 and the backing layer side thereof was prepared in the following manner.

Backing layer 1

The following backing layer 1 coating solution was coated in a proportion of 20 ml/m² and was then dried at 80° C. for 5 minutes.

| (Backing layer 1 coating solution) | |
|---|---|
| Gelatin | 10 g |
| Alumina sol, AS-100 (manufactured by Nissan Chemical Industrial Co., Ltd.) | 30 g |
| Acetone | 500 ml |
| Methanol | 400 ml |
| Dimethyl formamide | 100 ml |

Backing layer 2

The following backing layer 2 coating solution was coated over the backing layer 1 so as to be 20 ml/m² and was then dried at 80° C. for 5 minutes.

| (Backing layer 2 coating solution) | |
|---|---|
| Gelatin | 10 g |
| Diacetyl cellulose | 1 g |
| $SiO_2$ fine particles (having an average particle size of 3.0 μm) | 0.020 g |
| Acetone | 500 ml |
| Ethyl acetate | 500 ml |

Backing layer 3

The following backing layer 3 coating solution was coated on the film coated with the backing layer 2 thereon, so as to be 20 ml/m² and was then dried at 90° C. for 5 minutes.

| (Backing layer 3 coating solution) | |
|---|---|
| Gelatin | 10 g |
| Toluene | 700 ml |
| Methylethyl ketone | 300 ml |
| Polymethyl methacrylate (having an average particle size of 2.5 μm) | 0.03 g |
| Poly(methyl methacrylate/methacrylic acid: 60/40 in mol ratio) (having an average particle size of 2.1 μm) | 0.02 g |
| Higher aliphatic acid (or the salt thereof) or higher aliphatic acid ester (See Table 3) | 1 g |
| Fluorine-containing surfactant, (those of the anionic and cationic type) (See Table 3) (in a mol ratio of 1:1) Total | 0.5 g |

Table 3 shows the results of the kinematic friction coefficients, scratch resistance, antistaticity, adhesion resistance, high humidity slidability, finger-print adhesion resistance and pressure fog production resistance.

TABLE 3

| Sample | Backing layer 3: Fluorine-containing anionic surfactant | Backing layer 3: Fluorine-containing cationic surfactant | Backing layer 3: Higher aliphatic acid or aliphatic acid ester | Emulsion layer 12: Fluorine-containing anionic surfactant | Emulsion layer 12: Fluorine-containing cationic surfacant | Pressure fog | Fingerprint adhesion* | Kinematic friction coefficient | Scratch resistance | Antistaticity (Static mark) | Adhesion resistance | High humidity slidability: Backing layer side | High humidity slidability: Emulsion layer side | Remarks |
|---|---|---|---|---|---|---|---|---|---|---|---|---|---|---|
| III-1 | — | — | — | FA-7 | FA-2 | Δ | X | 0.39 | X | A | A | 0.42 | 0.22 | Comp. |
| III-2 | FA-7 | — | C-1 | FA-7 | FA-4 | ○ | ◎ | 0.22 | ○ | A | A | 0.35 | 0.22 | Inv. |
| III-3 | — | FK-2 | C-1 | FA-15 | FA-5 | ○ | ◎ | 0.22 | ○ | A | A | 0.22 | 0.23 | Inv. |
| III-4 | FA-7 | FK-2 | — | FA-16 | FA-8 | Δ | X | 0.39 | X | A | A | 0.19 | 0.23 | Comp. |
| III-5 | FA-7 | FK-2 | C-1 | FA-15 | FA-8 | ○ | ◎ | 0.22 | ○ | A | A | 0.19 | 0.23 | Inv. |
| III-6 | FA-12 | FK-4 | C-2 | FA-15 | FA-4 | ○ | ◎ | 0.22 | ○ | A | A | 0.18 | 0.22 | Inv. |
| III-7 | FA-16 | FK-5 | C-9 | FA-16 | FA-5 | ○ | ◎ | 0.22 | ○ | A | A | 0.18 | 0.23 | Inv. |
| III-8 | FA-18 | FK-15 | C-10 | FA-18 | FA-5 | ○ | ◎ | 0.23 | ○ | A | A | 0.18 | 0.23 | Inv. |
| III-9 | FA-19 | FK-8 | C-14 | FA-19 | FA-8 | ○ | ◎ | 0.23 | ○ | A | A | 0.19 | 0.23 | Inv. |
| III-10 | FA-19 | FK-15 | C-20 | FA-20 | FA-8 | ○ | ◎ | 0.22 | ○ | A | A | 0.19 | 0.22 | Inv. |
| III-11 | FA-15 | FK-13 | C-26 | FA-22 | FA-13 | ○ | ◎ | 0.22 | ○ | A | A | 0.19 | 0.22 | Inv. |
| III-12 | FA-20 | FK-17 | C-38 | FA-26 | FA-13 | ○ | ◎ | 0.23 | ○ | A | A | 0.18 | 0.23 | Inv. |
| III-13 | FA-24 | FK-17 | C-42 | FA-27 | FA-15 | ○ | ◎ | 0.22 | ○ | A | A | 0.19 | 0.22 | Inv. |
| III-14 | FA-24 | FK-18 | C-77 | FA-34 | FA-17 | ○ | ◎ | 0.23 | ○ | A | A | 0. 18 | 0.23 | Inv. |
| III-15 | FA-25 | FK-19 | C-81 | FA-41 | FA-19 | ○ | ◎ | 0.23 | ○ | A | A | 0.18 | 0.22 | Inv. |

Comp.: Comparison Inv.: Invention
*The three evaluators gave same results.

As is obvious from Table 3, it was proved that, when a sample was applied with a fluorine-containing anionic surfactant and a fluorine-containing cationic surfactant each to the outermost layer and also applied with a higher aliphatic acid (or the salt thereof) or an aliphatic hydrocarbon group-containing ester to the outermost layer of the backing layers, the resulting sample can remarkably be improved in the finger-print adhesion, pressure fog production at a high humidity and, particularly, in a high temperature and high humidity atmosphere, the adhesion resistance, the antistaticity and so forth.

What is claimed is:

1. A silver halide photographic light-sensitive material comprising (a) a support, (b) a silver halide photographic emulsion layer provided on a first side of said support, (c) a protective layer provided on said emulsion layer, and (d) a backing layer on a second side of said support opposite said first side, wherein an outermost layer of said first side or said second side contains a fluorine-containing anionic surfactant and a fluorine-containing cationic surfactant, and said outermost layer of said second side contains a compound represented by Formula A or B:

Formula A RCOOM wherein R is an aliphatic hydrocarbon group and M is a cation,

Formula B $R_1$—CO—O—X—O—CO—$R_2$ wherein $R_1$ and $R_2$ each represent an aliphatic hydrocarbon group and X is a divalent bonding group.

2. The material of claim 1, wherein said fluorine-containing anionic surfactant is a compound represented by the following Formula (FA):

(Cf)—Y Formula (FA)

wherein Cf represents a group having at least three fluorine atoms and at least two carbon atoms; and Y represents —COOM, —$SO_3M$, —$OSO_3M$, or —P(=O)$(OM)_2$ wherein M represents a hydrogen atom, an alkali metal or a quaternary ammonium group.

3. The material of claim 1, wherein said fluorine-containing anionic surfactant is a compound represented by the following Formula (FA'):

(Rd)—D—Y Formula (FA')

wherein Rf represents a fluorine-containing alkyl group having 3 to 30 carbon atoms or a fluorinated aryl group having 6 to 30 carbon atoms; D represents a divalent bonding group having 1 to 12 carbon atoms and at least one selected from the group consisting of —O—, —COO—, —CON($R_1$)— and —$SO_2$N($R_1$)— wherein $R_1$ represents an alkyl group having 1 to 5 carbon atoms; and Y represents —COOM, —$SO_3M$, —$OSO_3M$ or —P(=O)$(OM)_2$ wherein M represents a hydrogen atom, an alkali metal or a quaternary ammonium group.

4. The material of claim 1, wherein the content of said compound is 1 to 500 mg per square meter of the light-sensitive material.

5. The material of claim 1, wherein the content of said compound is 5 to 100 mg per square meter of the light-sensitive material.

6. The material of claim 1, wherein said fluorine-containing cationic surfactant is a compound represented by the following Formula (FK):

Formula (FK) Rh—T—$X^+Z^-$ wherein Rh represents a fluorine-containing hydrocarbon group having 3 to 20 carbon atoms; T represents a divalent bonding group; X represents a cation; and Z represent a counter anion.

7. The material of claim 1, wherein the total content of said fluorine-containing anionic surfactant and said fluorine-containing cationic surfactant is 0.1 to 1000 mg per square meter of the light-sensitive material.

8. The material of claim 1, wherein the total content of said fluorine-containing anionic surfactant and said fluorine-containing cationic surfactant is 1.0 to 150 mg per square meter of the light-sensitive material.

9. The material of claim 1, wherein said M in formula (A) represents Na, K, Li, Ca, Sr, Ba, $HN(R_2)_3$ or $N(R_2)_4$ wherein $R_2$ represents an alkyl group having 1 to 18 carbon atoms.

10. The material of claim 1, wherein said $R_1$ and $R_2$ in formula (B) each represent an aliphatic hydrocarbon group having 12 to 70 carbon atoms.

11. The material of claim 1 wherein a mol ratio of said fluorine-containing anionic surfactant to said fluorine-containing cationic surfactant is 1:10 to 10:1.

12. The material of claim 11 wherein said mol ratio is 3:7 to 7:3.

13. The material of claim 1 wherein said outermost layer on said first side is said protective layer.

14. The material of claim 1 wherein said outermost layer on said second side of said support is an outermost layer of said backing layer.

* * * * *